US006289782B1

(12) United States Patent
Watson, Jr.

(10) Patent No.: US 6,289,782 B1
(45) Date of Patent: Sep. 18, 2001

(54) SPOTTING RIFLE BARREL ALIGNING AND RETAINING SYSTEM

(75) Inventor: Fred W. Watson, Jr., Montross, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/426,367

(22) Filed: Oct. 25, 1999

(51) Int. Cl.[7] ..... F41A 23/00

(52) U.S. Cl. ..... 89/37.01; 89/37.04; 42/111; 42/79; 33/233; 33/245; 33/247; 33/248

(58) Field of Search ..... 89/1.41, 37.01, 89/37.04, 1.7; 42/75.02, 86, 75.01, 103, 100, 102; 33/246, 237, 233, 248, 241

(56) References Cited

U.S. PATENT DOCUMENTS

| | | | | |
|---|---|---|---|---|
| 2,333,514 | * | 11/1943 | Beresky . | |
| 2,645,855 | | 7/1953 | Ivy | 33/50 |
| 2,949,825 | * | 8/1960 | Musser et al. . | |
| 3,098,410 | * | 7/1963 | Giza . | |
| 3,476,349 | * | 11/1969 | Smith . | |
| 4,212,109 | * | 7/1980 | Snyder . | |
| 4,739,559 | | 4/1988 | Hohensee et al. | 33/233 |
| 4,791,748 | | 12/1988 | Leskinen | 42/75.02 |
| 5,092,071 | * | 3/1992 | Moore . | |
| 5,355,609 | * | 10/1994 | Schenke . | |
| 5,363,559 | * | 11/1994 | McCarty . | |
| 5,428,915 | * | 7/1995 | King . | |
| 5,531,040 | | 7/1996 | Moore | 42/103 |
| 5,657,546 | | 8/1997 | Canaday | 33/235 |
| 5,706,599 | | 1/1998 | Knight | 42/75.02 |
| 5,771,595 | | 6/1998 | Bell | 33/248 |
| 6,115,952 | * | 9/2000 | Rigler . | |

* cited by examiner

*Primary Examiner*—Charles T. Jordan
*Assistant Examiner*—Troy Chambers
(74) *Attorney, Agent, or Firm*—James B. Bechtel, Esq.; Peter J. Van Bergen, Esq.

(57) ABSTRACT

A spotting rifle barrel is aligned and retained relative to a launch tube and a spotting rifle receiver housing. A first annular lug is coupled to an outer portion of a breech end of the spotting rifle barrel. A second annular lug is coupled to an inner portion of the spotting rifle receiver housing. The spotting rifle barrel extends through the second annular lug so that a forward end of the first annular lug abuts an aft end of the second annular lug. The forward end of the first annular lug and the aft end of the second annular lug meet at a complementary radius of curvature. The first annular lug is retained in an abutting relationship with the second annular lug. A boresight adjustment assembly cooperates with a muzzle end of the spotting rifle barrel to adjust the boresight of the spotting rifle barrel while allowing for axial movement of the barrel.

34 Claims, 2 Drawing Sheets

SPOTTING RIFLE BARREL ALIGNING AND RETAINING SYSTEM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to gun aiming devices, and more particularly to a system for aligning and retaining a spotting rifle barrel.

BACKGROUND OF THE INVENTION

Spotting rifles are used to determine range to a target. In general, the spotting rifle is set for a specific range and a tracer or burning round is fired to see if the selected range was accurate. If not, corrections are made until the correct range is achieved. Frequently, a spotting rifle is coupled to another launching device. That is, the spotting rifle is used to select the range for the launching device. Accordingly, it is desirable to align the boresight of the spotting rifle with that of the launching device. The advent of the ballistically matched spotting round has greatly reduced the difficulty and time required to align the spotting round impact with the launching device's round. However, it. is still necessary to accurately align the spotting rifle barrel with the launching device.

A preferred solution to this problem is to adjust the barrel of the spotting rifle without having to relocate the entire spotting rifle in relation to the main launch tube or rifle. One such spotting rifle barrel alignment mechanism is disclosed in U.S. Pat. No. 5,657,546 in which the breech end of the spotting rifle barrel floats in a seat where it engages the spotting rifle's receiver housing. The spotting rifle barrel is clamped at its muzzle end to a bracket depending from the muzzle of the launch tube. When a spotting round is fired, inertia of the round moving towards the muzzle end of the spotting rifle barrel tends to drive the spotting rifle barrel out of its floating breech end seat in the receiver housing. Once out of its breech end seat, the spotting rifle barrel tends to lose its boresight. Further, because the muzzle end of the spotting rifle barrel is clamped to the muzzle of the launch tube, the inertia of the round causes the launch tube to bow slightly as forces generated by the movement of the spotting rifle barrel are transferred to the muzzle of the launch tube. This is especially true when the launch tube is made from a material such as fiberglass.

SUMMARY OF THE INVENTION

Accordingly, it is an object of the present invention to provide a system that can align and retain a spotting rifle barrel.

Another object of the present invention is to provide a spotting rifle barrel alignment system that retains its boresight upon the firing of a spotting round.

Still another object of the present invention is to provide a spotting rifle barrel alignment and retaining system that prevents bowing of a launch tube to which the spotting rifle barrel is coupled.

Other objects and advantages of the present invention will become more obvious hereinafter in the specification and drawings.

In accordance with the present invention, a system aligns and retains a spotting rifle barrel relative to a launch tube and a spotting rifle receiver housing. A first annular lug is coupled to an outer portion of a breech end of the spotting rifle barrel. A second annular lug is coupled to an inner portion of the spotting rifle receiver housing. The spotting rifle barrel extends through the second annular lug so that a forward end of the first annular lug abuts an aft end of the second annular lug. The forward end of the first annular lug and the aft end of the second annular lug meet at a complementary radius of curvature. Further, means are provided to retain the forward end of the first annular lug in an abutting relationship with the aft end of the second annular lug. A boresight adjustment assembly depends from a muzzle of the launch tube and contacts a muzzle end of the spotting rifle barrel. The boresight adjustment assembly adjusts the boresight of the spotting rifle barrel while allowing for axial movement relative thereto.

DETAILED DESCRIPTION OF THE INVENTION

Figure 1:
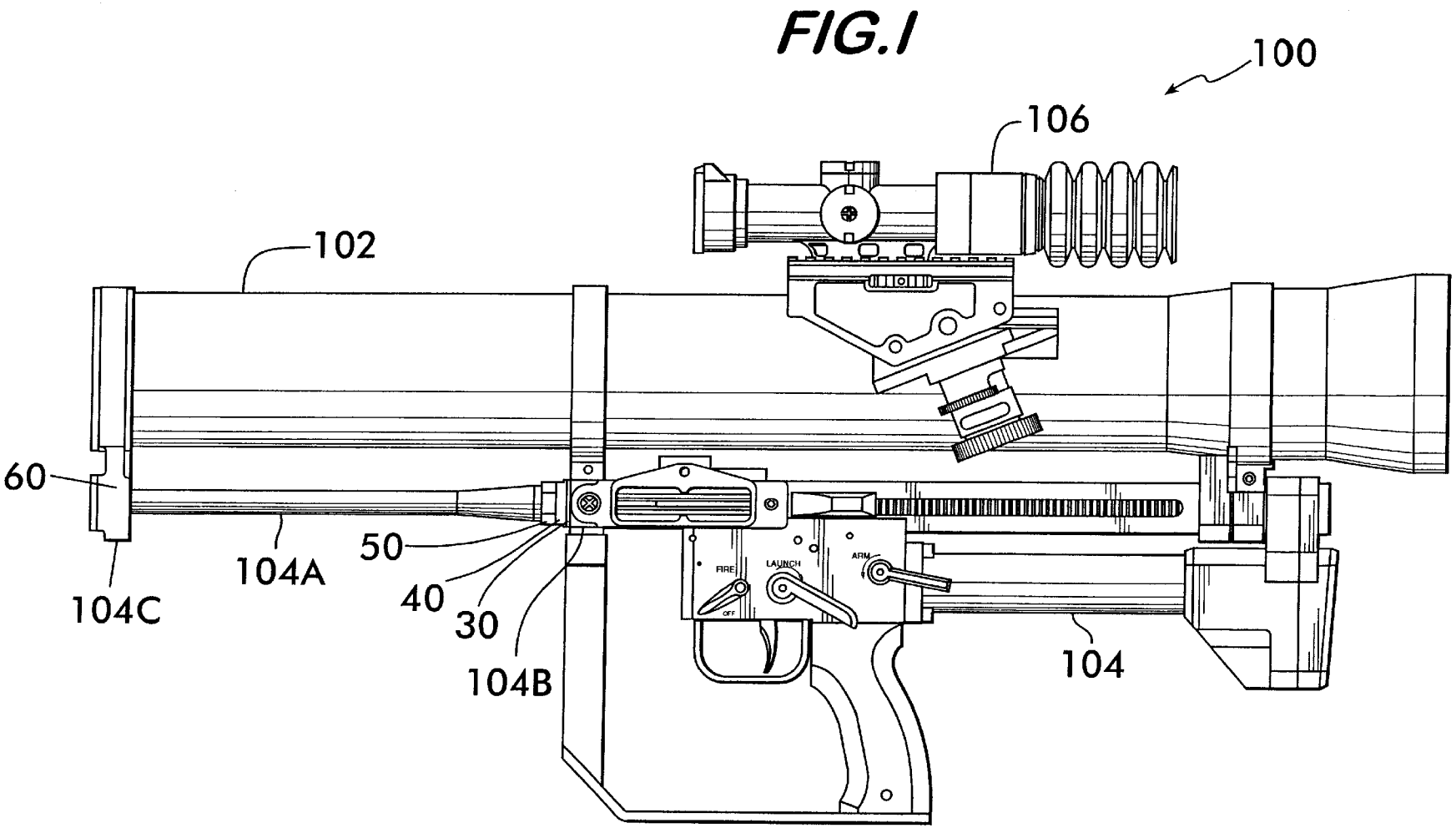
FIG. 1 is a side view of a launching device with a spotting rifle coupled thereto in accordance with the present, invention.

Referring now to the drawings, and more particularly to FIG. 1, a launching device is illustrated and referenced generally by numeral 100. Launching device 100 includes a launch tube 102 from which a main round (not shown) is fired. Launch tube 102 serves as a mount for a spotting rifle 104 and a sight unit 106. Spotting rifle 104 includes a spotting rifle barrel 104A from which a spotting or tracer round (not shown) is fired, a receiver housing 104B, and a boresight adjustment assembly 104C. Spotting rifle barrel 104A has its breech end supported in receiver housing 104B. The muzzle end of spotting rifle barrel 104A is supported by boresight adjustment assembly 104C.

Figure 2:
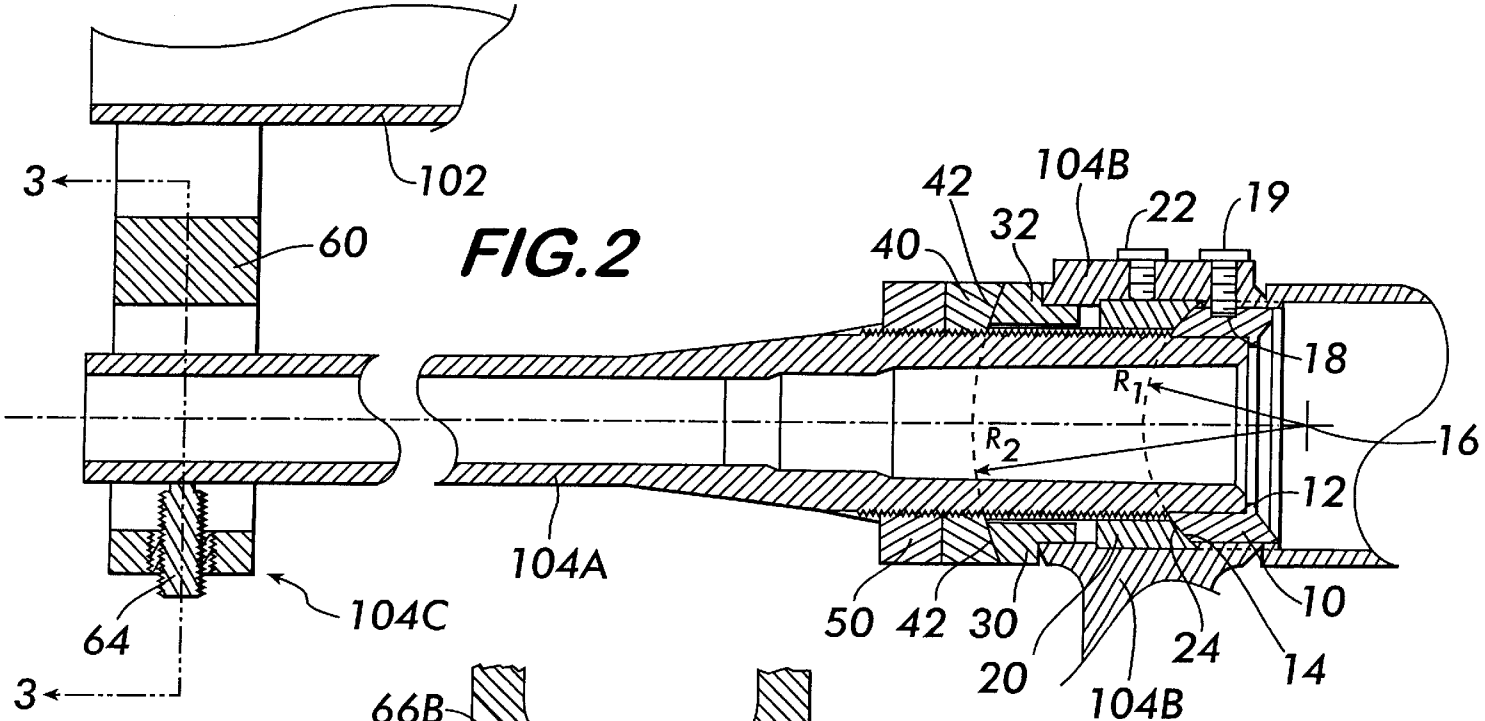
FIG. 2 is a side cross-sectional view of a spotting rifle barrel and the aligning and retaining system of the present invention used to couple the spotting rifle barrel between the launching device's launch tube and receiver.

Referring now additionally to FIG. 2, the details of a system for aligning and retaining spotting rifle barrel 104A relative to a (rocket) launch tube 102 and receiver housing 104B are illustrated. For simplicity of illustration, launch tube 102 and receiver housing 104B are shown only in their relevant portions. Specifically, the muzzle end of launch tube 102 and the forward end of receiver housing 104B are illustrated.

Coupled to the breech end of spotting rifle barrel 104A is an annular lug 10. Annular lug 10 can be integral with spotting rifle barrel 104A or could be threaded onto the breech end of spotting rifle barrel 104A. If a threaded coupling is used, annular lug 10 can incorporate an annular seating flange 12 that will abut the breech end of spotting rifle barrel 104A to assure proper positioning of annular lug 10 thereon. The forward end 14 of annular lug 10 is formed with a convex radius of curvature defined by a radius $R_1$ that originates from a point 16 located on the central longitudinal or boresight axis of spotting rifle barrel 104A in proximity to the breech end of spotting rifle barrel 104A. The exact location of point 16 is based on the position of boresight adjustment assembly 104C as will be explained further below. To prevent rotation of spotting rifle barrel 104A, a slot or notch 18 provided in annular lug 10 is engaged by a barrel position set screw 19 passing through receiver housing 104B.

Coupled to an inner diameter of receiver housing 104B is an annular lug 20. Annular lug 20 can be integral with or threaded into receiver housing 104B. If threaded into receiver housing 104B, a set screw 22 passing through receiver housing 104B can be used to engage annular lug 20 to hold it in position. Whether threaded into receiver housing 104B or integrated therewith, the aft end 24 of annular lug 20 is formed with a concave radius of curvature complementary to the radius of curvature of forward end 14 of annular lug 10. That is, radius $R_1$ also defines a concave radius of curvature of aft end 24. Further, the inside diameter of annular lug 20 is less than the outside diameter of annular lug 10. During assembly, spotting rifle barrel 104A with annular lug 10 coupled thereto is inserted through receiver housing 10411 until forward end 14 of annular lug 10 abuts aft end 24 of annular lug 20. Note that the complementary radius of curvature fit between forward end 14 and aft end 24 allows spotting rifle barrel 104A to be pivoted smoothly about point 16 during boresight adjustment of spotting rifle barrel 104A as will be explained further below.

To retain annular lug 10 and annular lug 20 in their abutting relationship, a variety of mechanisms can be used. In general, it is preferred that the retaining mechanism apply an axial force to spotting rifle barrel 104 so that annular lug 10 is pulled forward towards annular lug 20. In this way, the force of retention is aligned with the inertia of the fired spotting or tracer round.

One such mechanism for applying and maintaining the necessary axial force will be described by way of example. The mechanism includes an annular extension 30, a threaded ring 40 and, if needed, a lock nut 50. Annular extension 30 is coupled (e.g., integrated with or attached to) receiver housing 104B. Annular extension 30 is disposed about spotting rifle barrel 104A with sufficient clearance to allow barrel 104A to be pivoted about point 16. The forward end 32 of annular extension 30 is formed with a convex radius of curvature defined by a radius $R_2$ that originates from point 16. Threaded ring 40 is threaded onto spotting rifle barrel 104A. The aft end 42 of threaded ring 40 has a concave radius of curvature complementary to that of forward end 32. That is, radius $R_2$ also defines a concave radius of curvature of aft end 42. Lock nut 50 is threaded onto spotting rifle barrel 104A and is used to fix the position of threaded ring 40.

Figure 3:
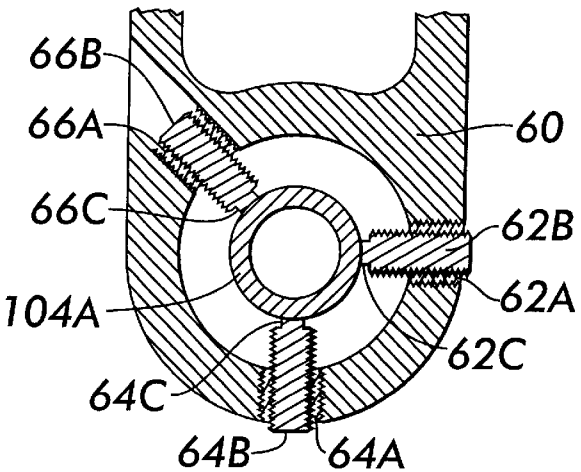
FIG. 3 is a cross-section taken along line 3—3 in FIG. 1 illustrating the boresight adjustment assembly of the present. invention.

Located at the muzzle end of spotting rifle barrel 104A is boresight adjustment assembly 104C which will be explained using FIGS. 2 and 3. Assembly 104C includes a bracket 60 depending from the muzzle of launch tube 102 and a plurality of adjustment screw assemblies 62, 64 and 66. Bracket 60 serves as a housing through which the muzzle end of spotting rifle barrel 104A passes. Adjustment screw assemblies 62, 64 and 66 (e.g., each of which can include a corresponding locking helicoil 62A, 64A and 66A set in bracket 60 with a corresponding set screw 62B, 64B and 66B passing therethrough) are distributed about bracket 60 to align the boresight of spotting rifle barrel 104A. Each set screw is positioned such that respective tips 62C, 64C and 66C contact the outer portion of spotting rifle barrel 104A as best seen in FIG. 3. That is, the muzzle end of spotting rifle barrel 104A is restrained from radial movement by assembly 104C but is not restrained axially. In this way, spotting rifle barrel 104A is free to expand or stretch axially without affecting the boresight of barrel 104A and without transferring any axial forces to launch tube 102 which could cause bowing thereof. The use of locking helicoils 62A, 64A and 66A prevents any movement of the corresponding set screw when the spotting rifle is fired.

In use, spotting rifle barrel 104A is inserted through annular lug 20 and boresight adjustment assembly 104C until annular lug 10 abuts annular lug 20. Annular extension 30, threaded ring 40 and lock nut 50 cooperate to apply and maintain an axial force that maintains the abutting relationship between annular lugs 10 and 20. Set screw assemblies 62, 64 and 66 are then adjusted as needed to change the boresight of spotting rifle barrel 104A. The radius of curvature fit between annular lugs 10 and 20, and annular extension 30 and threaded ring 40, allow spotting rifle barrel 104A to pivot about point 16 during the boresight adjustment thereof using adjustment screw assemblies 62, 64 and 66.

The location of pivot point 16 is determined by the plane at which adjustment screw assemblies 62, 64 and 66 contact spotting rifle barrel 104A. For example, in the illustrated. embodiment, the plane of contact defined by the adjustment screw assemblies (i.e., line 3—3 in FIG. 2) is aft of the muzzle opening of spotting rifle 104A. Accordingly, point 16 will be aft of the breech opening of spotting rifle barrel 104A.

The advantages of the present invention are numerous. A spotting rifle barrel is aligned and retained in alignment during the firing of a spotting round. Launch tube integrity is maintained as the inertia of the spotting round is not transferred to the launch tube since the spotting rifle barrel is only restrained axially at its breech end.

Although the invention has been described relative to a specific embodiment thereof, there are numerous variations and modifications that will be readily apparent to those skilled in the art in light of the above teachings. For example, annular extension 30 could be integral with receiver housing 104B or incorporated as part of annular lug 20. Further, as mentioned above, annular lug 10 could be integral with spotting rifle barrel 104A and annular lug 20 could be integral with receiver housing 104B. Note that if annular lug 20 is integral with receiver housing 104B, set screw 22 is not needed. It is therefore to be understood that, within the scope of the appended claims, the invention may be practiced other than as specifically described.

What is claimed as new and desired to be secured by Letters Patent of the United States is:

1. A system cooperating with a launch tube and a spotting rifle receiver housing for aligning and retaining a spotting rifle barrel, said system comprising:

a first annular lug coupled to an outer portion of a breech end of a spotting rifle barrel;

a second annular lug coupled to an inner portion of a spotting rifle receiver housing, wherein the spotting rifle barrel extends through said second annular lug and wherein a forward end of said first annular lug abuts an aft end of said second annular lug, and wherein said forward end of said first annular lug is convex and said aft end of said second annular lug is concave;

means for retaining said forward end of said first annular lug in an abutting relationship with said aft end of said second annular lug; and means depending from a muzzle of a launch tube and contacting a muzzle end of the spotting rifle barrel for adjusting the boresight of the spotting rifle barrel.

2. A system as in claim 1 wherein said second annular lug is fixed in position, and wherein said means for retaining comprises means for applying an axial force to the spotting rifle barrel forward of said second annular lug, wherein said forward end of said first annular lug is pulled up against said aft end of said second annular lug.

3. A system as in claim 1 wherein said means for adjusting the boresight of the spotting rifle barrel comprises:

a housing depending from the muzzle of the launch tube, said housing providing for the passage therethrough of the muzzle end of the spotting rifle barrel; and a plurality of adjustment screws passing through'said housing and distributed about the spotting rifle barrel, wherein each of said plurality of adjustment screws contacts an outer portion of the spotting rifle barrel.

4. A system as in claim 3 wherein said plurality of adjustment screws comprises three adjustment screws.

5. A system as in claim 1 wherein said first annular lug is integral with the breech end of the spotting rifle barrel.

6. A system as in claim 1 wherein said second annular lug is integral with the spotting rifle receiver housing.

7. A system as in claim 1 further comprising means for preventing rotation of the spotting rifle barrel about the central longitudinal axis thereof.

8. A system cooperating with a launch tube and a spotting rifle receiver housing for aligning and retaining a spotting rifle barrel, said system comprising:

a first annular lug coupled to an outer portion of a breech end of a spotting rifle barrel, said first annular lug defining an outside diameter;

a second annular lug coupled to an inner portion of a spotting rifle receiver housing, said second annular lug defining an inside diameter that is less than said outside diameter of said first annular lug, wherein the spotting rifle barrel extends through said second annular lug until a forward end of said first annular lug abuts an aft end of said second annular lug;

an annular extension coupled to and extending from the receiver housing, said annular extension disposed about the spotting rifle barrel forward of said second annular lug;

a threaded ring threadably engaging the outer portion of the spotting rifle barrel forward of said annular extension, wherein said threaded ring screws up against said annular extension and causes an axial force to be applied to the spotting rifle barrel wherein said forward end of said first annular lug is pulled up against said aft end of said second annular lug;

a housing depending from the muzzle of the launch tube, said housing providing for the passage therethrough of the muzzle end of the spotting rifle barrel; and a plurality of adjustment screws passing through said housing and distributed about the spotting rifle barrel, wherein each of said plurality of adjustment screws is adjustably positioned to contact an outer portion of the spotting rifle barrel for adjusting the boresight of the spotting rifle barrel.

9. A system as in claim 8 wherein said forward end of said first annular lug and said aft end of said second annular lug meet at a complementary first radius of curvature.

10. A system as in claim 9 wherein said first radius of curvature is defined by a radius that originates from a point that is on the central longitudinal axis of the spotting rifle barrel and in proximity to the breech end of the spotting rifle barrel.

11. A system as in claim 10 wherein said retaining ring and said threaded ring meet am complementary second radius of curvature.

12. A system as in claim 11 wherein said second radius of curvature is defined by a radius that originates from said point.

13. A system as in claim 8 further comprising a lock nut threadably engaging the spotting rifle barrel forward of said threaded ring to maintain the position of said threaded ring.

14. A system as in claim 8 wherein said plurality of adjustment screws comprises three adjustment screws.

15. A system as in claim 8 wherein said first annular lug is integral with the breech end of the spotting rifle barrel.

16. A system as in claim 8 wherein said second annular lug is integral with the spotting rifle receiver housing.

17. A system as in claim 8 further comprising a set screw passing through the spotting rifle receiver housing and partially into said first annular lug for preventing rotation of the spotting rifle barrel about the central longitudinal axis thereof.

18. A system cooperating with a launch tube and a spotting rifle receiver housing for aligning and retaining a spotting rifle barrel, said system comprising:

a first annular lug coupled to an outer portion of a breech end of a spotting rifle barrel;

a second annular lug coupled to an inner portion of a spotting rifle receiver housing, wherein the spotting rifle barrel extends through said second annular lug and wherein a forward end of said first annular lug abuts an aft end of said second annular lug, and wherein said forward end of said first annular lug and said aft end of said second annular lug meet at a complementary radius of curvature;

means for retaining said forward end of said first annular lug in an abutting relationship with said aft end of said second annular lug; and means depending from a muzzle of a launch tube and contacting a muzzle end of the spotting rifle barrel for adjusting the boresight of the spotting rifle barrel.

19. A system as in claim 18 wherein said radius of curvature is defined by a radius that originates from a point in proximity to the breech end of the spotting rifle barrel.

20. A system as in claim 18 wherein said second annular lug is fixed in position, and wherein said means for retaining comprises means for applying an axial force to the spotting rifle barrel forward of said second annular lug, wherein said forward end of said first annular lug is pulled up against said aft end of said second annular lug.

21. A system as in claim 18 wherein said means for adjusting the boresight of the spotting rifle barrel comprises:

a housing depending from the muzzle of the launch tube, said housing providing for the passage therethrough of the muzzle end of the spotting rifle barrel; and a plurality of adjustment screws passing through said housing and distributed about the spotting rifle barrel, wherein each of said plurality of adjustment screws contacts an outer portion of the spotting rifle barrel.

22. A system as in claim 21 wherein said plurality of adjustment screws comprises three adjustment screws.

23. A system as in claim 18 wherein said first annular lug is integral with the breech end of the spotting rifle barrel.

24. A system as in claim 18 wherein said second annular lug is integral with the spotting rifle receiver housing.

25. A system as in claim 18 further comprising means for preventing rotation of the spotting rifle barrel about the central longitudinal axis thereof.

26. A system cooperating with a launch tube and a spotting rifle receiver housing for aligning and retaining a spotting rifle barrel, said system comprising:

a first annular lug integral with an outer portion of a breech end of a spotting rifle barrel;

a second annular lug coupled to an inner portion of a spotting rifle receiver housing, wherein the spotting rifle barrel extends through said second annular lug and wherein a forward end of said first annular lug abuts an aft end of said second annular lug;

means for retaining said forward end of said first annular lug in an abutting relationship with said aft end of said second annular lug; and means depending from a muzzle of a launch tube and contacting a muzzle end of the spotting rifle barrel for adjusting the boresight of the spotting rifle barrel.

27. A system as in claim 26 wherein said forward end of said first annular lug is convex and said aft end of said second annular lug is concave.

28. A system as in claim 26 wherein said forward end of said first annular lug and said aft end of said second annular lug meet at a complementary radius of curvature.

29. A system as in claim 28 wherein said radius of curvature is defined by a radius that originates from a point in proximity to the breech end of the spotting rifle barrel.

30. A system as in claim 26 wherein said second annular lug is fixed in position, and wherein said means for retaining comprises means for applying an axial force to the spotting rifle barrel forward of said second annular lug, wherein said forward end of said first annular lug is pulled up against said aft end of said second annular lug.

31. A system as in claim 26 wherein said means for adjusting the boresight of the spotting rifle barrel comprises:

a housing depending from the muzzle of the launch tube, said housing providing for the passage therethrough of the muzzle end of the spotting rifle barrel; and a plurality of adjustment screws passing through said housing and distributed about the spotting rifle barrel, wherein each of said plurality of adjustment screws contacts an outer portion of the spotting rifle barrel.

32. A system as in claim 31 wherein said plurality of adjustment screws comprises three adjustment screws.

33. A system as in claim 26 wherein said second annular lug is integral with the spotting rifle receiver housing.

34. A system as in claim 26 further comprising means for preventing rotation of the spotting rifle barrel about the central longitudinal axis thereof.

* * * * *